United States Patent [19]

Luther et al.

[11] Patent Number: 4,779,536

[45] Date of Patent: Oct. 25, 1988

[54] KINETIC ENERGY PROJECTILE

[75] Inventors: Hans W. Luther, Kaarst; Winfried Rossman, Neuss; Ulf Hahn, Ratingen; Udo Sabranski, Willich, all of Fed. Rep. of Germany

[73] Assignee: Rheinmetall GmbH, Dusseldorf, Fed. Rep. of Germany

[21] Appl. No.: 16,382

[22] PCT Filed: Jan. 31, 1986

[86] PCT No.: PCT/EP86/00044

§ 371 Date: Dec. 11, 1986

§ 102(e) Date: Dec. 11, 1986

[87] PCT Pub. No.: WO86/05264

PCT Pub. Date: Sep. 12, 1986

[30] Foreign Application Priority Data

Mar. 7, 1985 [DE] Fed. Rep. of Germany ..... 3508053

[51] Int. Cl.[4] ..... F42B 13/16

[52] U.S. Cl. ..... 102/521; 102/501; 102/517; 102/703

[58] Field of Search ..... 102/501, 517, 520, 521, 102/703, 519

[56] References Cited

U.S. PATENT DOCUMENTS

| | | | |
|---|---|---|---|
| 582,982 | 5/1987 | Cope | 102/703 |
| 3,977,324 | 8/1976 | Stevenson et al. | 102/703 |
| 4,408,538 | 10/1983 | Deffayet et al. | 102/522 |
| 4,519,317 | 5/1985 | Rosenberg | 102/521 |

*Primary Examiner*—Harold J. Tudor

*Attorney, Agent, or Firm*—Spencer & Frank

[57] ABSTRACT

To increase the penetration effectiveness, a tip area of the sub-caliber projectile body of a kinetic energy projectile, which immediately follows the possible tip has a greater diameter D over its length L than the diameter d in the following areas of the projectile body.

5 Claims, 1 Drawing Sheet

KINETIC ENERGY PROJECTILE

BACKGROUND OF THE INVENTION

The invention relates to a subcaliber kinetic energy projectile of the type including a generally cylindrical elongated projectile body having a cone-shaped tip at its front end and a fin assembly at its rear tail end for fin stabilization, and wherein a propelling cage sabot formed of a plurality of segments, surrounds a central portion of the projectile body.

Such kinetic energy projectiles are known from German Pat. No. 1703507. Kinetic energy projectiles of the known species also make possible the attack of difficult armored targets against which projectiles based on the shaped charge principle are no longer sufficiently effective.

However, it has been found that, because of further improvements in the target armor, especially on account of the utilization of multi-layered armor, the penetration effectiveness of the kinetic energy projectiles described above no longer satisfies all of the demands made on it.

SUMMARY OF THE INVENTION

The object of the invention is to increase the penetration effectiveness of the known kinetic energy projectile so as to make possible the penetration of complicated multi-layer armor.

This object is achieved according to the present invention by a subcaliber kinetic energy projectile and propelling cage sagbot arrangement of the above described type wherein at least a part of the length of the front portion of the projectile body has a larger diameter than the following part of the projectile body.

Preferably the enlarged diameter portion immediately follows the base of the cone-shaped projectile tip and transitions at its rear end, in the form of a truncated cone, to the smaller diameter of the remaining part of the projectile body. Moreover, according to features of the invention, the length of the enlarged diameter portion is between 5% and 15% of the total length of the projectile body, and the diameter of the enlarged diameter portion is greater by 10–15% than the diameter of the remaining part of the projectile body.

A surprising increase in the effectiveness when firing on multiply armored targets, especially on spring-mounted armor plate, has been achieved by means of the proposed increase in the diameter in only one tip area, which has been proven through testing. Conservative estimates lead to the conclusion of an increase in effectiveness of more than 10% in connection with this improved kinetic energy projectile, compared with customary kinetic energy projectiles.

BRIEF DESCRIPTION OF THE DRAWINGS

The invention is further described by making reference to the drawings wherein.

DETAILED DESCRIPTION OF THE PROPOSED EMBODIMENT

Figure 1:
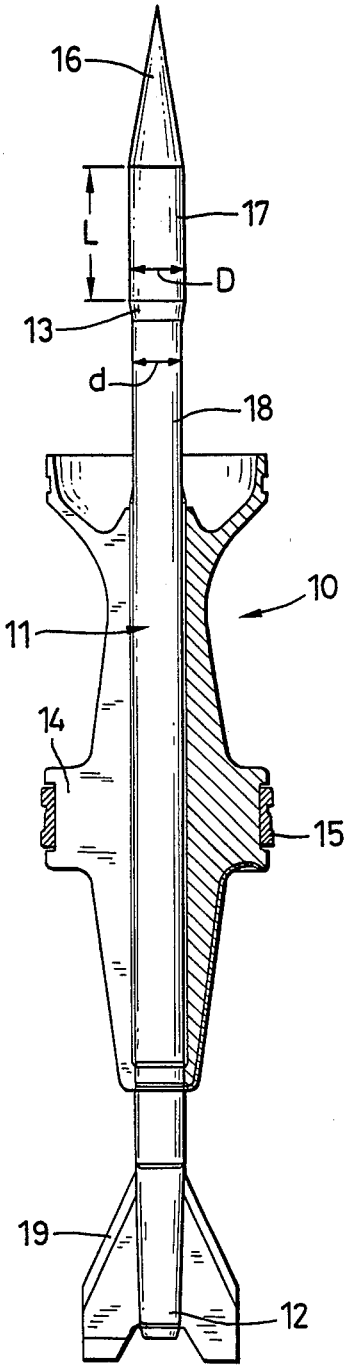
FIG. 1 is a side elevation of the kinetic energy projectile according to the invention with a partially removed propulsion cage.
Figure 2:
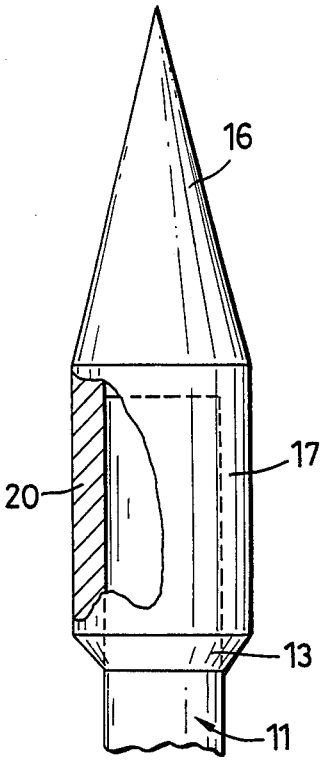
FIG. 2 is an enlarged detailed view of the tip area of the kinetic energy projectile of FIG. 1.

FIG. 1 shows a kinetic energy projectile 10 having a generally cylindrical sub-caliber projectile body 11 which ends in the forward direction in a cone-shaped tip 16 which is provided in its aft or tail section 12 with a finned tail assembly 19 for fin stabilization, and which is surrounded in its central area 18 by a propulsion cage sabot 14 consisting, in a known manner of a plurality of segments. The propulsion cage 14 has a drive band 15, the function of which is known and therefore need not be explained further. The projectile body 11 of the kinetic energy projectile 10 has, in its front or tip area 17, a larger diameter D along part of its length then the following central and aft areas 18, 12 of the projectile body 11. The tip area 17 of the kinetic energy projectile body 11 with its increased diameter directly connects to the base of the cone-shaped tip 16 and transitions, in the form of a truncated cone 13, into the central area 18 of the projectile body 11, having a smaller diameter d. The length L of the tip area 17 with an enlarged diameter D usefully is between 5% and 15%, preferably 10%, of the total length of the projectile body 11, while the diameter D of the front area 17 is larger by between 10% and 15%, preferably 12%, than the diameter d of the central area 18 of the projectile body 11. An especially simple and easy to produce increase of the diameter of the tip area 17 of the projectile body 11 is achieved by means of a sheath 20 (FIG. 2), which is forced onto the front end of the cylindrical projectile body 11.

We claim:

1. In a projectile arrangement for use against targets with multi-layered armor, said arrangement including a subcaliber kinetic energy projectile having a generally cylindrical projectile body with a front portion ending in a cone-shaped tip at its front end, a central portion, and a tail portion, a fin assembly mounted on said tail portion to provide fin stabilization, and a propulsion cage sabot, formed of a plurality of segments, surrounding said body in said central portion; the improvement wherein: said front portion of said projectile body has a larger diameter over part of its length than the following said central and tail portions of the projectile body; and said part having an enlarged diameter includes a cylindrical portion, which immediately follows said cone-shaped tip, which has a length (L) which is between 5% and 15% of the total length of the projectile body, and which has a diameter (D) which is larger by between 10% and 15% than the diameter of said central portion of the projectile body, whereby the armor piercing effectiveness of the projectile is increased.

2. A projectile arrangement according to claim 1, wherein said part of said front portion which is of increased diameter further includes a transition portion which immediately follows said cylindrical portion, and which is in the form a truncated cone extending to said central portion of the projectile body having a smaller diameter.

3. A projectile arrangement according to claim 1 wherein said projectile body comprises an elongated cylindrical member, and a sheath which forms said part having an enlarged diameter and said cone-shaped tip, and which is forced onto the front end of said cylindrical member.

4. A projectile arrangement according to claim 1 wherein said length (L) is 10% of the total length of said projectile body.

5. A projectile arrangement according to claim 1 wherein said diameter (D) is 12% larger than said diameter of said central portion.

* * * * *